United States Patent [19]

Old et al.

[11] Patent Number: 4,946,355

[45] Date of Patent: Aug. 7, 1990

[54] ORBITAL PUMP

[76] Inventors: Russell A. B. Old, P.O. Box 74, Encinitas, Calif. 92024; Francis B. Oldham, 8301 Cornell, St. Louis, Mo. 63132

[21] Appl. No.: 370,029

[22] Filed: Jun. 22, 1989

[51] Int. Cl.[5] ..... F04C 2/00; F04C 15/02

[52] U.S. Cl. ..... 418/16; 418/164; 418/186; 418/195

[58] Field of Search ..... 418/16, 19, 29, 30, 418/183, 186, 195, 160, 161, 163, 164; 123/43 A, 241; 92/12.2, 71

[56] References Cited

U.S. PATENT DOCUMENTS

| | | | |
|---|---|---|---|
| 1,866,398 | 7/1932 | Craig | 123/43 A |
| 2,101,051 | 12/1937 | Cuny | 418/195 X |
| 3,333,577 | 8/1967 | Mongitore | 123/43 A X |
| 3,347,049 | 4/1969 | Chestosky | 418/29 |
| 4,137,019 | 1/1979 | Hofmann . | |
| 4,138,930 | 2/1979 | Searle | 123/43 A X |
| 4,363,294 | 12/1982 | Searle | 123/43 A |
| 4,441,869 | 4/1984 | Larsen et al. . | |

OTHER PUBLICATIONS

"Moyno Pumps Combine Characteristics . . . ", 1975, Moyno Pump Division, Robbins & Myers, Inc., pp. 2–4.

"Pumping Abrasive Liquids with Progressing Cavity Pumps", (Journal of Paint Technology), Robbins & Myers, Inc., 1973.

"Megator Sliding-shoe Pumps", Megator Corporation, Sep. 1975.

*Primary Examiner*—Michael Koczo
*Assistant Examiner*—Douglas J. Makosy
*Attorney, Agent, or Firm*—Jerome A. Gross

[57] ABSTRACT

A positive displacement pump is particularly adapted for corrosive, abrasive and viscous liquids. It employs a combination of orbital and nodding movements provided by a unique mechanism. A rotor member, mounted eccentrically on a drive shaft, fits closely within a pumping chamber which it drives in an orbital path along an inclined plate having fluid inlet and outlet ports. The resultant cyclic increase and decrease in volume of the chamber beneath the rotor member draws in fluid and discharges it under pressure. For fluids of greater viscosity (or where reduced flow rate is desired) the angle of tilt is reduced, without lessening the power afforded for pumping.

10 Claims, 5 Drawing Sheets

ORBITAL PUMP

BACKGROUND OF THE INVENTION

1. Field of the Invention

This invention relates to a positive displacement pump which operates by a combination of orbital and nodding movements, and is capable of continuous adjustment from zero to maximum flow.

2. Description of Related Art

Operations in which pumps must function reliably and satisfy special requirements range widely. In pumping human blood, for instance into and through dialysis machines, the fluid to be moved is extremely delicate, and must not be roughly handled or subjected to steep pressure gradients or high shears and, of course, must be kept scrupulously clean. In contrast are pumps for sewage; such pumps must have long life, reasonable cost, and tolerance of anything that can appear in a sewage system, including metals, flexible solids, corrosives and abrasives and fibrous materials. For blood, one form of pump used is a series of rollers mounted on a wheel, bearing against a constrained, flexible plastic tube, a variety of the peristaltic type. In contrast, sewage pumps are usually of either the progressing cavity or velocity head (centrifugal) type, which sliding shoe pumps are used to move suspended abrasives, such as mine de-watering operations or sludge pumping.

The nature of the fluid to be pumped—particularly its viscosity—plays a considerable part in the selection of the type of mechanism to be adopted, as well as the materials to be used. The fluid may be volatile, corrosive, abrasive, viscous and/or delicate; it may also be non-homogeneous and possess more or less lubricity.

Despite the huge variety of uses of pumps, there are only two main types—velocity head and positive displacement. The velocity head type, most of which are centrifugal pumps, are usually used to deliver low viscosity fluids at relatively low pressures; although the feedwater pumps used in power stations are multi-stage centrifugal machines which deliver up to 3,500 psi at large flow rates.

Velocity-head pumps develop their performance by generating high fluid velocity; this is converted to pressure in specially shaped divergent passages. To accommodate high fluid velocities, specially shaped passages in both rotating and static parts are used, and these passages may be costly to produce. But while ordinarily not mechanically complex, velocity heads are usually unsuitable for use with high viscosity fluids (because of shear resistance) or with suspended matter unless modified by rubber lining or special wear-resistant casings.

While delivery of velocity head pumps may be reduced by restricting the flow without changing the pump speed, with positive displacement pumps a fixed volume of displacement is delivered for every stroke or revolution; the output can only be changed by altering their internal geometry.

Unlike velocity head pumps, which are usually centrifugal, positive displacement pumps appear in an enormously wide variety of types: gear pumps, pistons, peristaltic, sliding shoes, swash-plates, eccentrics, sliding and rotating vanes, three-, four-or more pointed rotors, helices, progressing cavities, and other types. Some may rely on the lubricity of the fluids pumped and on very small clearance to minimize internal leakage and hence pressure loss.

Positive displacement pumps are sometimes called upon to move fluids that are both corrosive and abrasive. Examples may vary from chocolate, toothpaste, and peanut butter, which require a high level of cleanliness, to coal and tungsten carbide slurries. Conventional pumps handling such products have maintenance costs and repair frequency that might be unacceptably high.

For moving abrasive and corrosive fluids, two special types of positive displacement pumps, have been heretofore available: (1) The Moneaux pump, introduced in the 1930's and sometimes known as the "Moyno" or "progressing cavity" pump, consists of a two plane, single helix, floating rotor, turning inside a double helix stator. The latter is often made of rubber, to improve the resistance to fluids with abrasive entrained solids. The rubber facing also provides a degree of sealing between the rotor and stator. The stator may be made of other materials with special resistance qualities as needed. As better understanding of wear resistance developed, these pumps became available in a variety of different material combinations which increase their useful lives. (2) The Megator type introduced in the 1940's; it is also somewhat tolerant of abrasive fluids; a metal component works with one which is rubber or plastic faced. This positive displacement pump uses a circular eccentric, rotating in the close-fitting cavity in a shoe that is caused to reciprocate against a plate incorporating inlet and discharge ports.

Besides abrasiveness and corrosiveness, a third quality that can impose difficulties is high viscosity, which may vary considerably with temperature. External bypasses can be used to alter the delivery volume without altering the pumps' total throughput, but this does not solve the viscosity problem.

The ability to alter the rate at which the fluid is delivered may be essential or at least desirable for many industrial processes. Special pumps heretofore known which can provide continuous flow adjustment, such as swashplate pumps, are unsuitable if problems such as abrasiveness, corrosiveness and varying viscosity may be present to any substantial extent. Throttling of positive displacement pumps is not possible. By-passing involves mechanical complication and wastes power. Moreover, some pumped fluids are adversely affected by being treated roughly, and may suffer from chemical or structural changes. A practical flow control method is to vary the pump speed, using a multi-speed gearbox or a variable speed motor. These expedients are costly and complex by comparison with a pump whose delivery rate is easily adjustable, as here disclosed.

SUMMARY OF THE INVENTION

The orbital pump that is the subject of this application is particularly suited to handling viscous, abrasive fluid. The components that are most subject to wear can be readily made from, or coated with, rubber, plastic or hard-surfaced metals; the effects of wear can thereby be reduced to acceptable levels. In addition, the present pump is capable of easy, continuous adjustment from near zero output to maximum flow.

In the present invention, pumping is achieved by a combination of orbital movement and nutation (nodding movement). A rotor member (or members) mounted eccentrically onto a shaft turns a pumping chamber member causing it to orbit on a track, inclined from perpendicular to the power shaft. Each rotor member has a spherical segment surface which wipes a cylindrical side wall portion of its pumping chamber as, during half of the orbit, the pumping chamber bottom wall moves tiltingly sideward and downward relative to the underside of the rotor, to draw in fluid through its bottom port, and then during the other half of the orbit reverses, tilting toward the other side and upward to expel the fluid.

When only a single pumping chamber is used, the pumping discharge takes place only during half of the cycle of rotation. However, in the embodiment of invention which utilizes two pumping chambers, separated from each other by a diametric wall, each chamber with its own rotor attached eccentrically to the power shaft, the pumping discharge takes place during both halves of the cycle of rotation.

DESCRIPTION OF THE PREFERRED EMBODIMENTS

Figure 1:
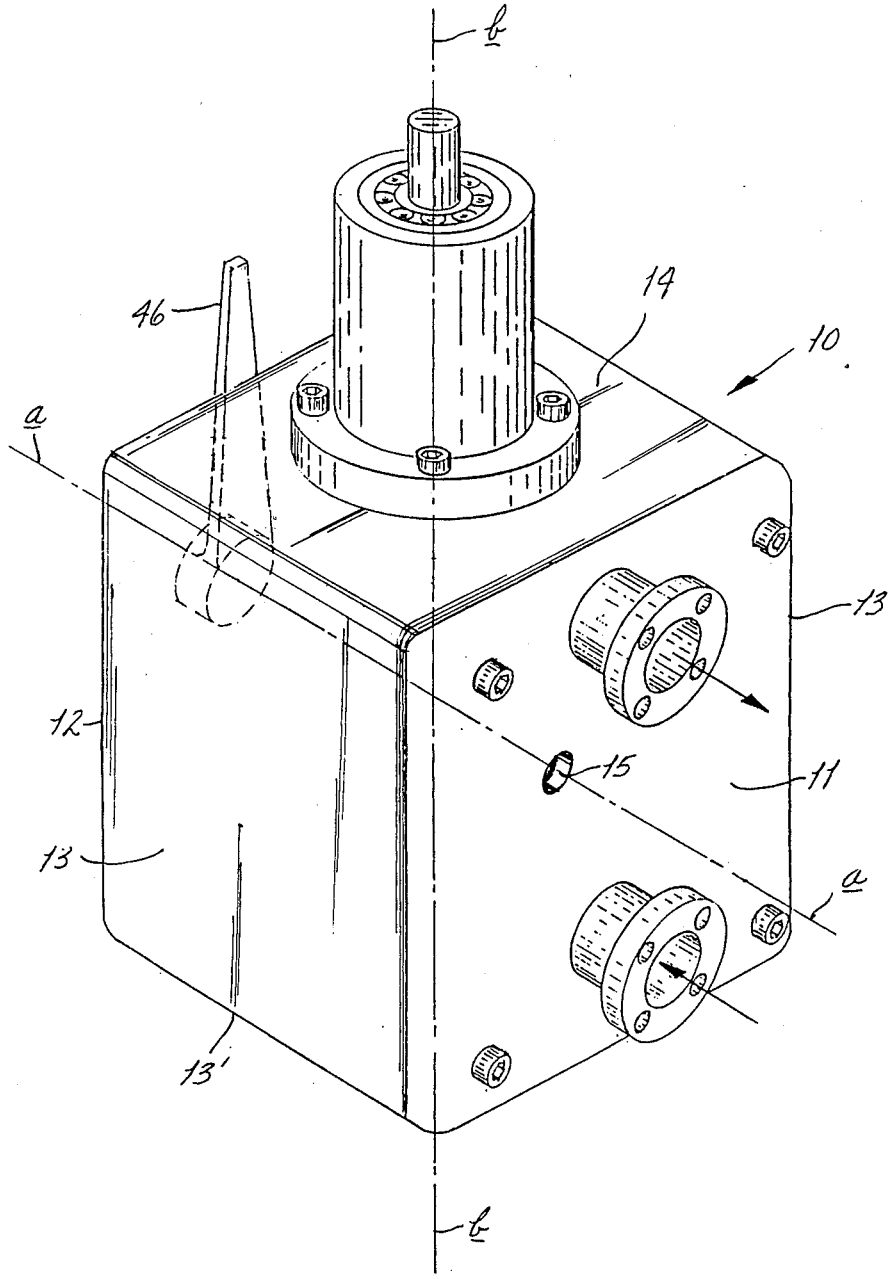
FIG. 1 is a perspective view of the exterior of a pump embodying the present invention. The arrows show the directions of liquid inflow and outflow. The phantom lines show the pump's two principal operating axes.
Figure 2:
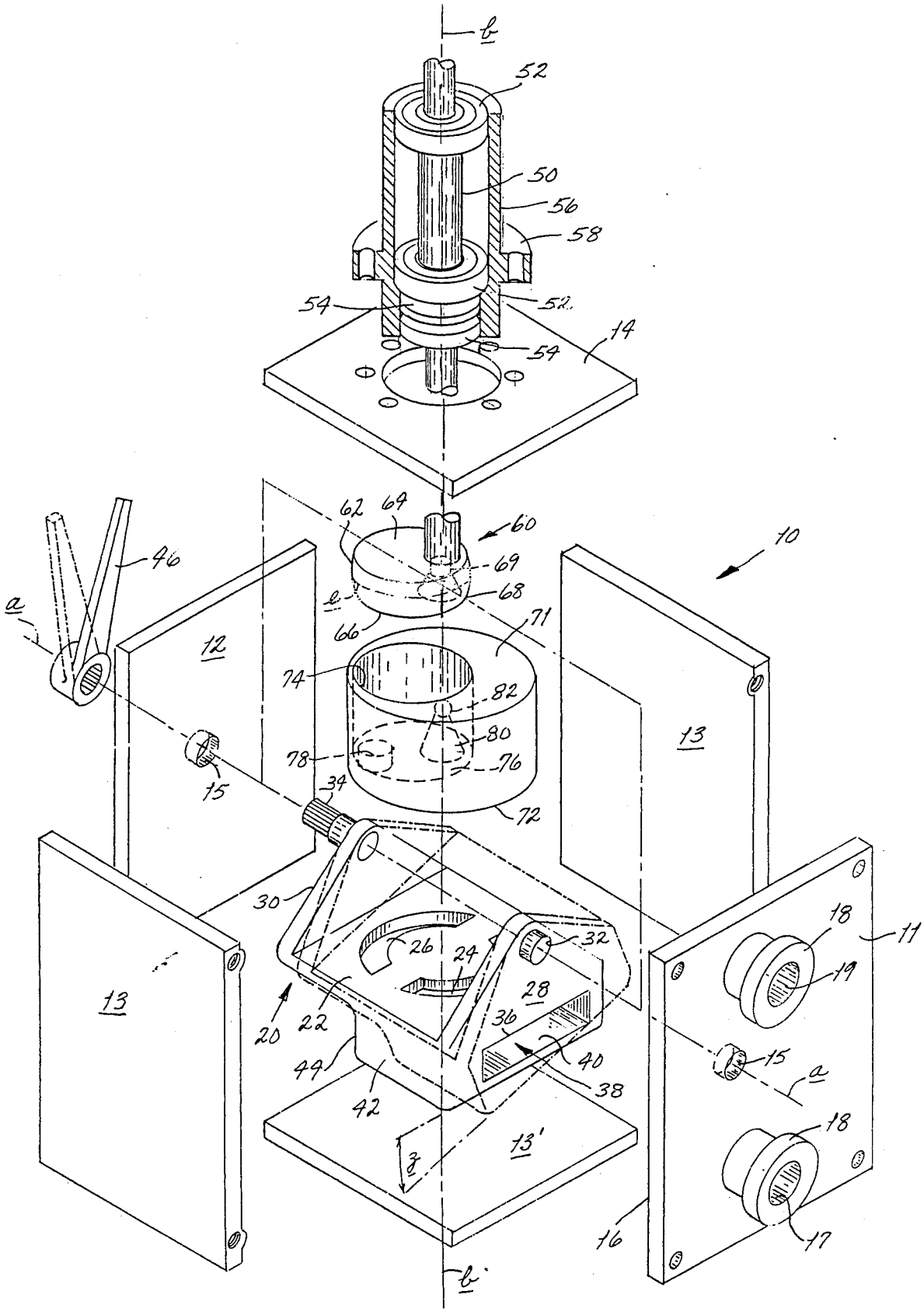
FIG. 2 is an exploded perspective view, somewhat schematic, of the pump of FIG. 1. The parts so shown exploded include an inclinable port plate assembly, which is common to all illustrated embodiments of the invention and whose inclined position is shown in phantom lines. Also shown exploded are a 360° rotor member and its pumping chamber, one of the interchangeable embodiments of rotor-chamber assemblies.

Referring to FIGS. 1 and 2, a pump embodying the present invention may have a substantially rectangular casing generally designated 10, preferably formed of metal, whose interior (or parts thereof) may be coated with substances such as rubber or plastic designed to reduce abrasion or corrosion from the material pumped. As shown in these drawings, the forward wall 11 may be removably affixed by bolts to the adjacent walls, such as side walls 13, bottom wall 13, and the top wall 14. Alternately, access for assembly and repair may be supplied by making the top wall 14 removable instead. A rear wall 12 completes the casing 10.

The working parts of the pump are defined hereafter in reference to the intersection of two axes. The first of these is a tilt axis designated a—a; the second axis, which is perpendicular to and intersects the first, is the power shaft axis designated b—b. While their orientation may be any convenient one, in the drawings the power shaft axis b—b is vertical; the tilt axis is then horizontal and is shown herein as extending forward and aft.

The forward-and-aft axis a—a is defined by tilt axis bushings 15 in the forward and rear walls 11, 12 respectively, which bushings are provided with conventional seals to avoid leakage. The forward wall 11 has a planar inner surface 16 perpendicular to the axis a—a. Extending through the forward wall 11, at a level below the axis a—a, is an inflow opening 17 having a connector-mounting flange 18 to which may be attached a connecting tube from a source of the fluid material to be supplied. At a point remote from the inflow opening 17 is an outflow opening 19 having a similar connector-mounting flange 18. For convenience this outlet opening 19 is also shown in the front wall but above the axis a—a.

Mounted along the axis a—a for tilt thereabout through an angle z is a port plate assembly generally designated 20. It is made up of a port plate 22 having an arcuate inlet port 24 and a similar outlet port 26, each of which occupies nearly 180° of a circular portion which serves as a track whose midwidth trace c is planar. When the port plate assembly 20 is untilted as for idling, the center point of the midwidth trace c will lie along the power shaft axis b—b.

The port plate assembly is in effect cradled along the axis a—a by perpendicular, somewhat triangular end plates, namely a forward end plate 28 and a rear end plate 30. While the upper surface of the port plate 22 is conveniently shown to be flat, instead it might be somewhat cupped or have some means to guide or confine an orbiting pumping chamber as hereinafter referred to; however, the inlet and outlet ports 24, 26 must lie in the planar circular track trace c.

A forward stub shaft 32, projecting forwardly along the axis a—a from the forward end plate 28, is received sealedly in the forward tilt axis bushings 15; a somewhat longer rear stub shaft 34, whose aft end is splined, projects rearwardly through the rear bushing 15 to extend beyond the rear wall 12, where it mounts the splined interior bore of a tilt handle 46. The handle 46 adjusts the rate of pumping delivery by tilting the port plate assembly 20 through any chosen part of the angle z, which extends preferably about 15° from horizontal, as shown in phantom lines.

Further describing the port plate assembly 20: beneath the port plate 22 and extending from the forward end plate 28 back to a point between the arcuate ports 24, 26 is an inflow chamber generally designated 38, having a broad mouth 36 seen in FIG. 2 just behind the front wall's inflow opening 17. As an idealization, the mouth 36 would be arcuate about the axis a—a, but since the inflow chamber 38 must lie beneath the planar track trace c, for practicality a straight mouth 36 is here shown; it and the inflow opening 17 are together broad enough to provide flow communication throughout the tilt angle z. Since the mouth 36 is presented against the planar inner surface 16 of the forward wall 11, it effectively seals thereagainst.

The inflow chamber 38 is completed by a chamber bottom wall 40, which may be substantially parallel to and spaced beneath the port plate 22, and by side walls 42 which extend aft to a chamber rear wall 44; this extends upward to join the port plate 22 just aft of its arcuate inlet port 24. Discharge from the outlet port 26 goes directly into the open space within the casing 10, pressurizing it, and thence out through the outflow opening 19.

Along the axis b—b is mounted a driving shaft 50 of an electric motor or other source of rotary power, not shown. The position of the drive shaft 50 is fixed by upper and lower bearings 52 held, along with seals 54, in a metal sleeve 56 having a flange 58 adapted for bolting onto the casing top wall 14. In the embodiment of invention shown in FIG. 2, pumping is achieved by the interaction of a rotor member generally designated 60 secured eccentrically to the lower end of the shaft 50, and the eccentric cylindrical cavity 74 of a pumping chamber member generally designated 70, hereafter described, mounted on the port plate 22. The rotor member 60 is a segment of a sphere, having a 360° spherical wall 62 delimited by flat upper and lower surfaces 64, 66, which are parallel to an equator e through which the axis a—a passes as seen exploded upward in FIG. 2. Since the spherical wall 62 of the rotor member 60 must maintain sealed in contact with the wall of the cylindrical cavity 74 throughout the angle of tilt z, the latitudinal extent of the spherical wall 62 between the upper and the lower rotor surfaces 64, 66 must be at least twice as great as the angle of tilt z, that is, preferably about 30°. A sealing coating of some elastomer may advantageously be utilized on this wall 62 to minimize leakage.

The eccentric mounting of the rotor member 60 onto the bottom end of the shaft 50 is such that the member 60 acts as a crank to drive the pumping chamber member 70 around in an orbit as hereafter described. A conical recess 68 is formed in the rotor member 60 immediately below and concentric with the lower end of the shaft 50. The recess 68 has a cylindrical top portion 69 centered at the intersection of the axes a—a and b—b; this receives the pylon 80 of the pumping chamber member 70 now to be described.

The pumping chamber member 70 is here shown as a relatively shallow cylindrical body having an undersurface 72 which moves orbitally on the surface of the port plate 22 (shown to be flat). Formed eccentrically within the upper surface 71 of the pumping chamber member 70 is a cylindrical cavity 74 whose inner diameter is such as to fit snugly about the spherical wall 62 of the rotor member 60. The cavity 74 has a preferably flat inner bottom surface 76 from which arises an off—center alignment pylon 80. The pylon's distance from center of the cavity 74 equals the eccentricity of the rotor member 60 from the shaft axis b—b. The pylon 80 has a hemispherical top 82 which fits for free tilting at the axis a—a within the conical recess 68 of the rotor member 60.

Opposite the pylon 80, spaced from it a distance equal to the radius of the circular track trace c, is a chamber flow port 78 through the chamber bottom surface 76. As the eccentrically mounted rotor member 60 drives the pumping chamber 70 around on the port plate 22, the flow port 78 will follow the circular track trace c, communicating successively with the arcuate inflow and outflow ports 24, 26. The spacing between the ends of the two arcuate ports 24, 26 slightly exceeds the diameter of the flow port 78 of the pumping chamber 70, so that the chamber flow port 78 cannot be open to both the inflow and outflow ports 24, 26 at the same time.

The movement of the pumping chamber member 70 relative to the 36020 spherical segment rotor 60 during a cycle of revolution may be described as a combination of writhing and tilting. The 360° spherical surface of the wall 62 will maintain substantial sealed contact with the cavity wall 74 throughout the cycle, as the bottom 76 of the pumping chamber, in a first half of a cycle of rotation, moves farther from the lower surface 64 of the rotor member 60 and sucks in liquid as its port 78 registers with the inlet port 24 of the port plate 22, and in the opposite half of its rotation lifts upward nearer to the lower surface 66 of the rotor member 60 to drive the liquid out through the chamber port 78, then in registration with the arcuate outlet port 26. This action will become clearer after considering the other embodiments of invention, now to be described.

The FIG. 2 embodiment is subject to the disadvantage that pumping delivery is afforded through only one-half of the cycle of rotation. To provide pumping delivery substantially uninterrupted through the entire cycle of registration the alternate embodiment of FIG. 3 may be preferred. This utilizes all the same members illustrated in FIG. 2 except the rotor 60 and the pumping chamber 70. Instead, a rotor assembly generally designated 90 having two near-180° rotor members each generally designated 91 (sometimes referred to as "180° rotor members"), is utilized, each of these having parallel upper and lower surfaces 92, 93 respectively and part-spherical surfaces 94 similar, except in their angular extent, to the spherical wall 62 of the FIG. 2 embodiment, and of equal latitudinal extent from their equator e which (as in the FIG. 2 embodiment) is intersected by the fore-and-aft axis a—a. The rotor members 91 are positioned eccentrically to the shaft 50 by posts 87 which extend downward from a cross-yoke member 85 affixed to the shaft bottom end. Where the two rotor members 91 face each other, they are separated by a gap g whose width is defined by the angled inward-presented- surfaces 96. Their spacing reaches a minimum at the equator e to provide sealing against the diametrical wall 108 dividing the pumping chamber member generally designated 100, hereafter describe.

The pumping chamber member 100 is here shown to have a flat surface wall 101 and a cylindrical outer wall 102. Its interior is hollow, being made up of a pair of substantially semi-cylindrical (sometimes here referred to merely as "semi-cylindrical") open-topped cavities 104 each having a substantially semi-cylindrical outer wall 106, a substantially flat-sided diametrical divider wall 108 and a preferably flat inner bottom wall 109 having a flow port 110 penetrating through the bottom surface 101. The side surfaces of the diametrical divider wall 108 fit sealedly within the gap g of the angled rotor surfaces 96 as the chamber member 100 tilts sideward, down, oppositely sideward and up during each cycle of rotation. While the bottom wall 109 of one of the cavities 104 is moving tiltingly downward relative to the lower surface 93 of one of the rotor members 91, drawing the liquid to be pumped through its flow port 110, the bottom wall 109 of the other cavity 104 is moving relatively upward toward the rotor member on its side, driving the pumped liquid out through the arcuate outlet port 26 of the port plate 22. Hence with the FIG. 3 embodiment there is pumping delivery substantially throughout the entire cycle of rotation of the shaft 50.

Figure 3:
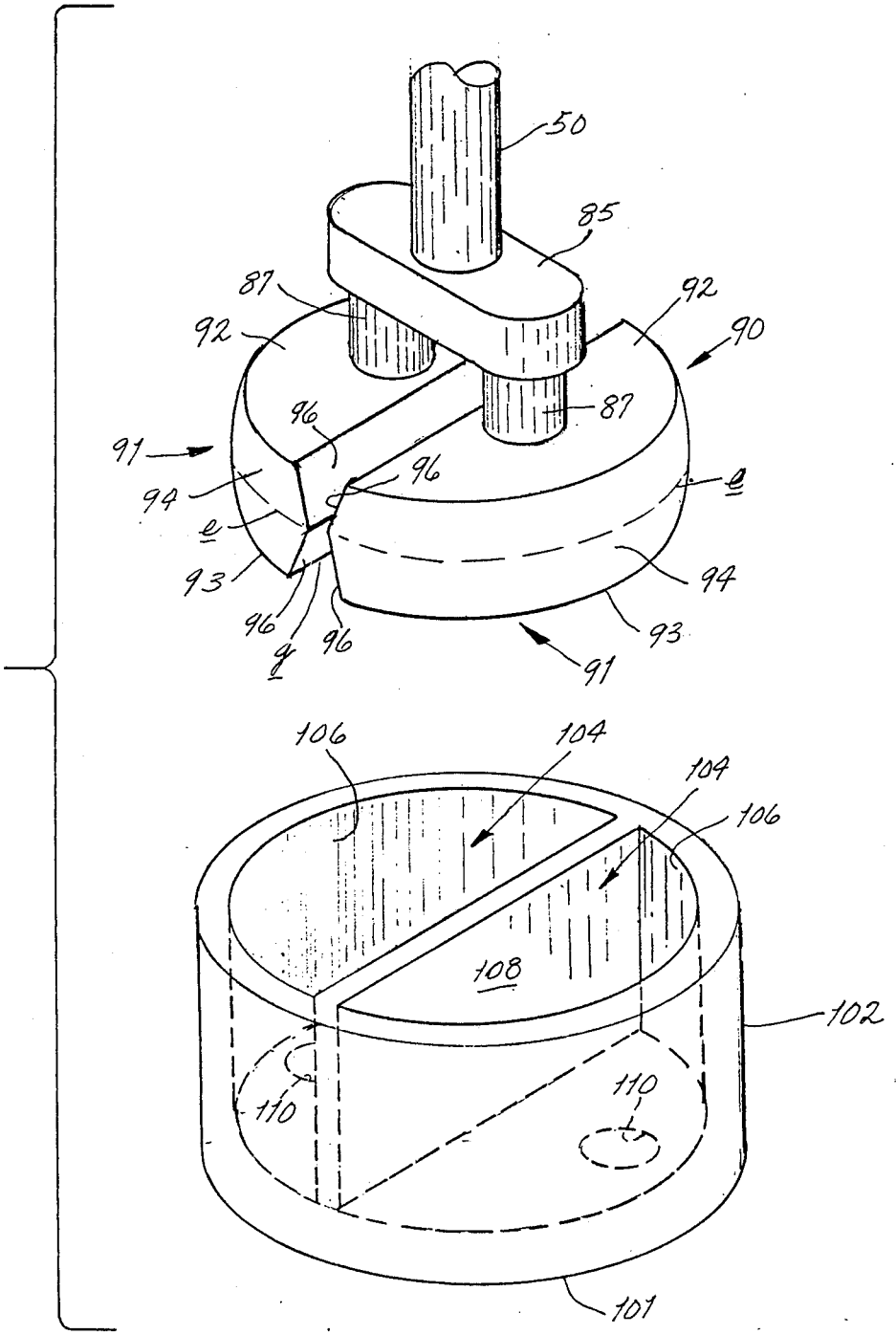
FIG. 3 shows, as an alternative to the rotor and pumping chamber of FIG. 2, a pumping chamber member having two substantially semi-cylindrical pumping chambers and a rotor utilizing two substantially 180° rotor members, one in each chamber.
Figure 4:
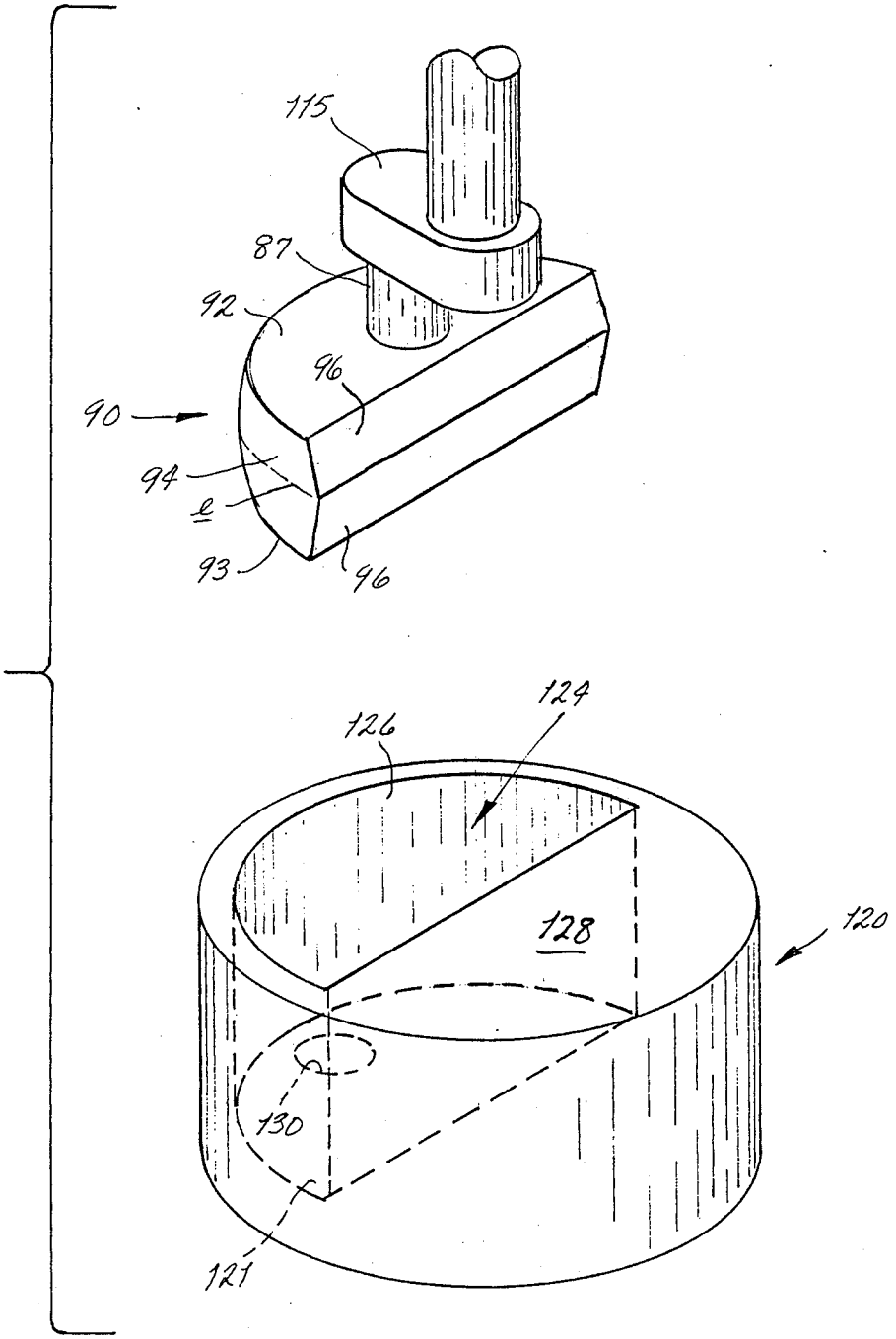
FIG. 4 shows, as another alternative construction, a single substantially semi-cylindrical pumping chamber with a single near-180° rotor member therein, which functions as would one-half of the FIG. 3 embodiment.

The essential feature of eccentricity of each rotor member to its pumping chamber is shown more clearly in the embodiment of FIG. 4. This embodiment is effectively one-half of the FIG. 3 embodiment Utilizing the terminology as employed in describing the FIG. 3 embodiment, a half yoke member 115 extending outward from the shaft 50 supports a single downward-projecting post 87 bearing a single near-180° rotor member 91, which is the same as one of the two rotor members 91 of the FIG. 3 embodiment, having corresponding surfaces 92, 93, 94, 96 and an equator e. Hence these portions of this near 180° rotor member 91 are marked with the same numerals as in the FIG. 3 embodiment, and no further description of them need be given.

For this FIG. 4 embodiment, the pumping chamber member generally designated 120 may have the same exterior dimensions as the pumping chamber member 100 of the FIG. 3 embodiment; but has only a single semi-cylindrical cavity generally designated 124. This is of the same size as one of the cylindrical cavities 104, and bounded in part by a semi-cylindrical outer wall 126. In order to use the near-180° rotor member of the FIG. 3 embodiment, the vertical wall 128 must be offset from a true diameter a distance equal to half of the minimum width of the gap g. In the bottom wall 121 of the cavity 124 is a flow port 130 corresponding to the flow port 110 in the FIG. 3 embodiment. Pumping delivery will take place during only one-half of the cycled rotation, as with the FIG. 2 embodiment.

Figure 5A:
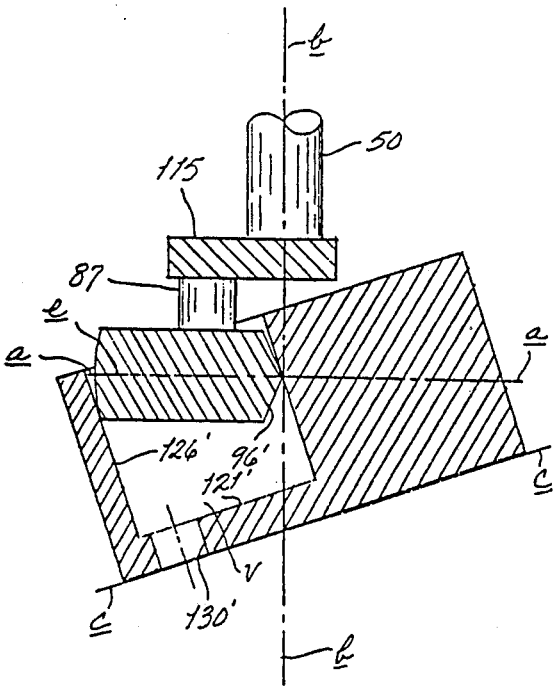
FIGS. 5*a* and 5*b* are partial sectional drawings of an idealized embodiment slightly modified from FIGS. 3 and 4 in which the flat side chamber wall is actually diametrical. They illustrate the alignment of these parts relative to the principal operating axes of the pump, and how, when the track part bearing the pumping chamber is inclined from horizontal, on each rotation of its shaft the single 180° rotor member will perform a suction stroke and a pressure stroke.
Figure 5B:
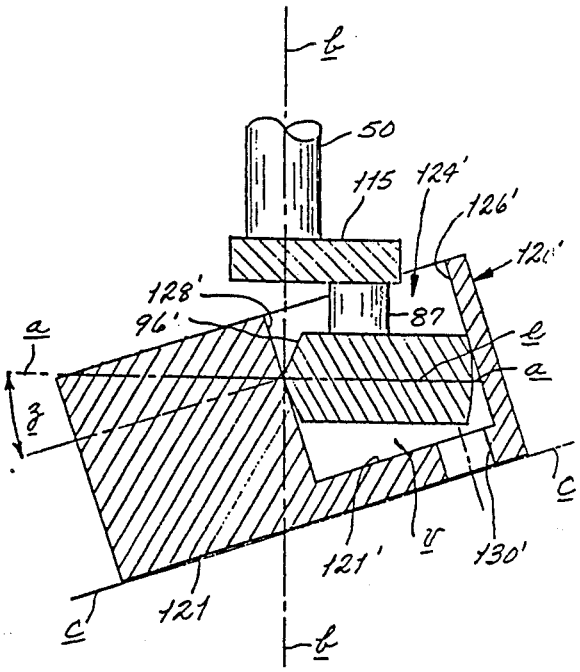

While the proportions of the members of the FIG. 4 embodiment were chosen as precisely the same as the FIG. 3 embodiment, the idealized embodiment of FIG. 5 shows the relation of the inner surface of a 180° rotor member to the intersection of the forward-and-aft axis a—a with the intersecting power axis b—b. In this embodiment the cavity wall 126' is truly semi-cylindrical because it extends to a truly diametric vertical wall 128', as does the flat bottom wall 121'. This requires the rotor member inner surface 96' to extend farther inward than in the FIGS. 3 and 4 embodiments. As illustrated, this inner surface 96' tapers to an intersection at the level of the equator e, to seal against the vertical wall 128' whether the pumping chamber 124' is at the high side of the slope of the tilted track trace c, as shown at the right side of FIG. 5, or at its low side as shown at the left.

Reviewing FIG. 5, as exemplary of the operating principle of all embodiments: while the equator e of a rotor member remains at the level of the fore-and-aft axis a—a, the effective volume of the pumping chamber member 120' varies from a minimum volume v, when in position as shown at the right side of FIG. 5, to the much larger volume w when in the position shown at the left side. Assuming that the driving axis b—b is maintained vertical and the other axis a—a horizontal, as the pumping chamber 120' rotates on the plane of the track trace c it will first dip out of the plane of the drawing and then continue downward to reach the 180° removed position shown at the left of FIG. 5 where the chamber reaches its effective maximum volume w. As the effective volume so increases, fluid is drawn into the pumping chamber through its bottom flow port 130'. Then as rotation continues and the chamber dips oppositely out of the plane of the drawing and rises to the position shown at the right of FIG. 5, the fluid is forced out of the pumping chamber 124' through the bottom flow opening 130'. In order to achieve the inflow and outflow as just described, the midpoints of the arcuate inlet and outlet ports 24, 26, spaced at 180° from each other, will thus be on a horizontal line regardless of the inclination of the port plate through the angle z.

It is further apparent from FIG. 5 that if the handle 46 of FIGS. 1 and 2 is moved to reduce the angle of inclination z from its maximum of approximately 15°, the relative volumes v, w will gradually approach equality; when the angle z becomes 0°, there will be no pumping and the mechanism will idle. Thus pumping delivery may be reduced without varying the pump speed or reducing the power available throughout a range of continuous flow adjustment. This is of great importance for pumping liquids at different flow rates, to compensate for viscosity changes.

While in each of the embodiments shown the rotor members maintain the pumping chamber members substantially in position on the port plate 22, the fact that the pumped flow is directed through the interior of the casing 10 on its way to the outflow opening 19 serves to apply the outflow pressure to hold the pumping chamber members 70, 100, 120, 120' yieldably against the surface of the port plate surface 22. The pressure so applied helps to maintain a substantial degree of sealing without the abrasion which might occur if mechanical means were utilized for this purpose. Also while the inflow and outflow ports 24, 26 of the port plate z—z are shown arcuate, each occupying nearly 180° and being separate from each other by a width little greater than the diameter of the chamber bottom port 78, it is apparent that the latter could be somewhat elongated and the inflow and outflow arcuate ports 24, 26 be somewhat shortened, so that in each case they total no more than 180°.

If one dispensed with the advantage of applying the outflow pressure so as to hold the pumping chamber, and so shortened the arcuate inflow and outflow ports, flexible tubing to these from the exterior might be provided. This would allow the angle of tilt controlled by the handle 46 to range to the opposite side of horizontal from that shown in FIG. 2, in which case the direction of pumping flow would be reversed. However should such flow reversal be desired, Applicants believe that it may be provided more advantageously by connecting the inflow and outflow openings 17, 19 to a separate external reversing valve.

In this description and the claims, the term "semi-cylindrical" or "nearly semi-cylindrical" are used somewhat interchangeably for simplicity and because in the context they are not misleading.

Since in the embodiments illustrated, close tolerances are not required, coatings to protect against corrosion and abrasion may be applied whenever needed, and delivery rate may be varied with changes in weight or viscosity of pumped fluids without sacrifice of power, the present invention is believed to fill a long-felt need in a manner not taught by prior art.

As various other modifications may be made in the constructions herein described and illustrated without departing from the scope of the invention, it is intended that all matter contained in the foregoing description or shown in the accompanying drawings shall be interpreted as illustrative rather than limiting.

We claim:

1. A rotary pump for liquid substances, comprising casing means having liquid inlet and outlet connections, a shaft inlet opening including bearing means defining a shaft axis, a port plate assembly positioned within said casing means substantially opposite said shaft inlet opening, said port plate assembly including a port plate with a substantially circular track inclined or inclinable from perpendicular to such shaft axis, and two ports, one for inflow and the other for outflow, whose midpoints are spaced substantially 180° from each other along said track, and means connected through said casing means to said port plate inflow port form a supply source from which liquid may be drawn, the casing further having an outflow connection, in combination with a rotatable hollow pumping chamber member accommodated within the casing and having an inner cylindrical wall portion and a ported bottom seated on said port plate and including a flow opening movable along said track thereof, a rotatable driving shaft supported on said shaft axis and extending through said shaft inlet opening, and rotor member means each eccentrically mounted on said shaft and fitted within said inner cylindrical wall portion of said pumping chamber member, each said means comprising a substantially spherical segment having an equator in a plane perpendicular to said shaft and being of sufficient latitudinal extent, on both sides of the equator, to maintain contact with said inner cylindrical wall despite relative inclination of the port plate out of parallelism with the equator of said spherical segment, whereby, with said port plate assembly so inclined that its track is out of parallelism with the equator of said spherical segment, on rotation of the shaft the volume within said pumping chamber member beneath said rotor member means will increase as the pumping chamber member flow opening means is in registration with said track inflow port, and will decrease as the pumping chamber member flow opening means is in registration with said track outflow port.

2. A rotary pump as defined in claim 1, in which when the driving shaft axis is vertical, a line connecting the midpoints of said inflow and outlet ports of port plate is substantially horizontal regardless of its inclination.

3. A rotary pump as defined in claim 1, in which said port plate is positionable perpendicular to said shaft axis for idling, and is inclinable from perpendicular for pumping delivery.

4. A rotary pump as defined in claim 3 in which said port plate assembly including cradling support means pivotally mounted about a transverse axis perpendicular to and intersecting such shaft axis, by the pivoting of which means such inclination is afforded, together with means to supply liquid inflow from the casing liquid inlet to the port plate inflow port regardless of the inclination of said port plate.

5. A rotary pump as defined in claim 4 wherein said means to supply liquid inflow comprises a planar area along the interior of a wall of said casing about the casing liquid inlet, which planar area is perpendicular to such transverse axis, and an inflow compartment in said port plate assembly inflow communication with its said inflow port, said compartment having a mouth opening presented substantially sealedly against said wall planar area and being sufficiently larger than said casing liquid inlet therethrough to maintain substantially sealed flow communication throughout the range of such inclination.

6. A rotary pump as defined in claim 1, in which said outflow port of the port plate empties into said casing means outward of said pumping chamber member, whereby to apply against said pumping chamber member the liquid outflow pressure, thereby assisting in sealing said pumping chamber member against said port plate.

7. A rotary pump as defined in claim 1, wherein the arcuate lengths of said inflow and outflow ports are substantially equal, and said arcuate length of one of said ports plus that of a flow opening of said chamber member bottom approaches but does not exceed 180° .

8. A rotary pump as defined in claim 1, wherein said spherical segment rotor member means so eccentrically mounted on said shaft is a single rotor member whose equator is of 360° extent, and said pumping chamber means has a cylindrical chamber bore whose diameter substantially equals that of said rotor member and whose cylinder axis is perpendicular to said port plate and eccentric relative to said circular track, whereby rotation about the shaft axis of said eccentrically mounted rotor member so drives the pumping chamber that its flow opening means follows such circular track.

9. A rotary pump as defined in claim 1, wherein said pumping chamber means includes a substantially diametrical wall delimiting a substantially semi-cylindrical chamber portion, and wherein said rotor member means includes a rotor member nearly 180° in extent fitted within said chamber portion.

10. A rotary pump as defined in claim 1, wherein said pumping chamber member includes a fixed divider wall extending diametrically across its cylindrical inner wall, whereby to divide said member into two substantially semi-cylindrical pumping chamber portions, and wherein said rotor member means comprises two rotor members each nearly 180° in extent, separated by and defining a gap therebetween so sized as to fit over said divider wall with such clearance as permits rotation of said pumping chamber member along said track despite the relative inclination of said port plate, and wherein the flow openings in said chamber bottom associated with each said rotor means are spaced opposite each other at a distance substantially equal to the diameter of said circular track, whereby one of said semi-cylindrical pumping chambers is open to the inflow port as the other is open to the outflow port.

* * * * *

UNITED STATES PATENT AND TRADEMARK OFFICE

CERTIFICATE OF CORRECTION

PATENT NO. : 4,946,355

DATED : August 7, 1990

INVENTOR(S) : Old, Russell A.B., and Oldham, Francis B.

It is certified that error appears in the above-identified patent and that said Letters Patent is hereby corrected as shown below:

Column 3, line 58, delete "bottom wall 13" and substitute ---bottom wall 13'---.

Column 5, line 65, delete "36020" and substitute ---360°---.

Column 6, line 37, delete "describe" and substitute ---described---.

Column 6, line 39, after "flat" insert ---bottom---.

Column 6, line 53, delete "93" and substitute ---92---.

Column 6, line 64, after "embodiment" insert a period.

Column 9, line 2, delete "form" and substitute ---from---.

Signed and Sealed this

Twenty-fourth Day of September, 1991

*Attest:*

HARRY F. MANBECK, JR.

*Attesting Officer*

*Commissioner of Patents and Trademarks*